United States Patent [19]

Ege et al.

[11] Patent Number: 4,834,618

[45] Date of Patent: May 30, 1989

[54] OIL FEEDING SYSTEMS

[75] Inventors: Sigmund Ege; Anders T. Aasbo; Freddy Heigh, all of Oslo, Norway

[73] Assignee: Standard Telefon og Kabelfabrik A/S, Oslo, Norway

[21] Appl. No.: 123,735

[22] Filed: Nov. 23, 1987

[30] Foreign Application Priority Data

Dec. 12, 1986 [NO] Norway ..... 864662

[51] Int. Cl.[4] ..... F04B 9/12

[52] U.S. Cl. ..... 417/46; 417/404

[58] Field of Search ..... 417/46, 403, 404, 314

[56] References Cited

U.S. PATENT DOCUMENTS

| | | | |
|---|---|---|---|
| 54,247 | 4/1866 | Dennisson | 417/314 |
| 411,263 | 9/1889 | Sherman | 417/314 |
| 742,471 | 10/1903 | Morrice et al. | 417/314 |
| 4,070,107 | 3/1978 | Ferrentino | 417/53 |
| 4,419,056 | 12/1983 | Ege | 417/53 X |
| 4,544,328 | 10/1985 | Credle, Jr. | 417/46 X |
| 4,666,374 | 5/1987 | Nelson | 417/46 X |

*Primary Examiner*—Leonard E. Smith

*Attorney, Agent, or Firm*—Spencer & Frank

[57] ABSTRACT

An oil cable pumping plant including at least one oil tank and at least one air/gas driven piston type oil pump connected to the oil tank, at least one air/gas source connected to the air/gas inlet of the pump via a pressure control. An exit for the air/gas as well as an oil exit are connected to at least one oil filled cable, and an oil flow indicator. The pump in its normal operating condition provides a predetermined oil pressure at its outlet. An oil flow control is interconnected between the oil flow indicator and the air/gas pressure control for controlling the oil.

14 Claims, 3 Drawing Sheets

OIL FEEDING SYSTEMS

BACKGROUND OF THE INVENTION

Field of the Invention

The present invention relates to oil feeding systems for oil filled cables. The oil pressure in such cables has traditionally been maintained using oil reservoirs such as small cylindrical tanks containing mild steel or stainless steel cells.

The reservoir could either be of the low pressure type (either gravity feed or variable pressure) or it could be of the high pressure type (either with pre-pressurized cells, or with the cells manifolded so that the gas pressure could be varied).

Long submarine crossings will normally require high pressure reservoirs, particularly if the water is deep and it is required that the pressure inside the cable always is higher than that of the surrounding water.

If a submarine cable should become severed (for instance by a dragging ships anchor) so much oil could be lost that the capacity of the reservoirs would not be enough during the subsequent cooling period, and water would be sucked into the cable.

In order to maintain the cable free of water, even after a complete severance, it has become customary to use pumping plants rather than reservoirs for important submarine crossings. The pumping plants are generally provided with fairly large size storage tanks, and with a system for reducing the outflow of oil once the cable has been cooled down. Such systems have been designed to keep the cable free of water for periods as long as 60 days.

Most pumping plants depend on a supply of electrical power to operate. To protect the cable even in case of a failure of the power supply, it is customary either to provide the pumping plant with a diesel engine-generator unit or to use a pump driven by compressed gas taken from bottles, as a back-up for the electrically driven pump.

Pumping plants for oF cables generally use a so-called 'canned' motor-pump assembly i.e. (the unit is hermetically sealed, and the oil flows through the rotor of the motor) to avoid any possibility of vacuum leaks. These pumps are expensive and require an elaborate control system for starting and stopping to maintain oil pressure within preset limits. An air driven pump on the other hand will only pump when the oil pressure falls below the pressure for which the gas pressure is set, and it will stop pumping as soon as this pressure is again reached.

From U.S. Pat. No. 4,405,292 (Haskel) there is known a pneumatically controlled rate pump system. Upon receiving a pilot signal, the piston type pump will make one stroke and then wait for the next pilot signal. The pump is provided with a counter which records the number of pump cycles and thus the volume of fluid that has been pumped. This results, however, in a rather uneven fluid flow.

SUMMARY OF THE INVENTION

It is the object of this invention to provide an oil cable pumping plant which makes use of the many desirable features of air driven pumps and to overcomes the drawbacks of existing pumping plants by improving the control of the pump.

One feature of the invention is that a controlled flow of oil to the cable (in case the cable has been severed) is obtained by adjusting the speed at which the pump piston is reciprocating to match a predetermined flow program, rather than delaying the next pump stroke.

Another feature of the invention solves the problem of operating the air driven pump at very slow speeds and low pressures. Air is applied at the necessary low pressure and flow during most of the piston stroke, but once a signal has been received indicating that the piston is at, or near, the end of its stroke both pressure and flow are increased sufficiently to operate the sliding air piston past the critical position. As soon as the piston has started to move in the opposite direction, air pressure and flow are again reduced to that required for normal pumping, or somewhat lower at the first part of the next stroke, so as to compensate for a higher oil flow portion of the stroke during the high air pressure and flow.

Another feature of the invention is that in a piston type air driven pump which is provided with two seals on the piston rod, the chamber between these seals is filled with degasified oil. This seal oil may be of the same type as kept in the main cable tank, or it may have greater viscosity to give better lubrication. A leak in the inner seal will therefore not effect the ability of the pump to operate properly. A control system may be arranged to analyze the pressure rise or drop in said chamber, as well as other data from the operation of the pump, to determine which of the two seals is defective and transmit this information to a remotely located control center.

For a double acting reciprocating pump, the situation is somewhat different, because the piston rod seal will be subjected to fluid pressure or vacuum according to whether the piston is moving towards or away from the seal. With an effective seal this will normally not present any problem as long as the pump is operating at a fairly high rate. If the pump, at times, is required only to maintain pressure on a fluid, there is a risk that the seal may be subjected to a vacuum for a period long enough to allow air to pass into the fluid. This air in the fluid may cause cavitation in the pump and contamination of the fluid being pumped. It is another feature of the present invention to avoid this difficulty.

BRIEF DESCRIPTION OF THE DRAWINGS

Above mentioned and other features and objects of the present invention will clearly appear from the following detailed description of embodiments of the invention taken in conjunction with the drawings, where.

DESCRIPTION OF THE PREFERRED EMBODIMENTS

Figure 1:
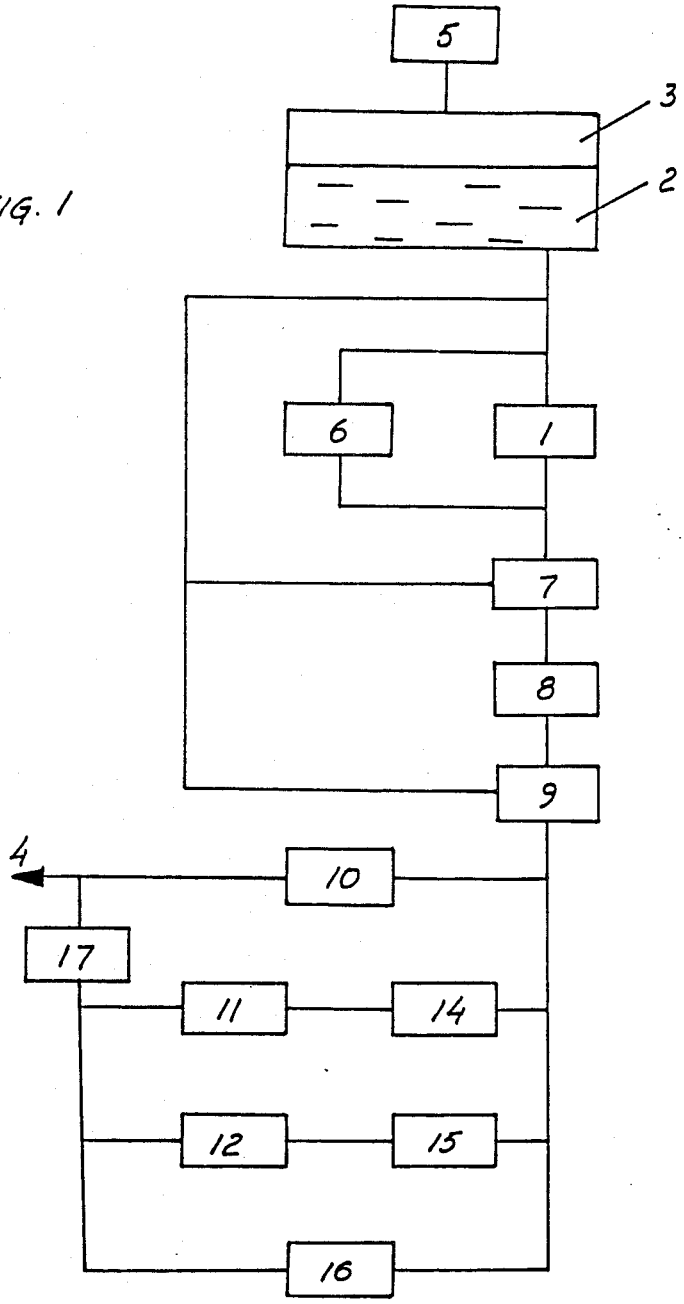
FIG. 1 shows a schematic view of a simplified pumping plant using electrically driven pumps.

In FIG. 1 is schematically illustrated a pumping plant comprising an electrically driven canned pump 1 pumping oil 2 from a storage tank 3 to a cable 4 (not shown). A vacuum pump 5 maintains vacuum over the oil 2 in the tank 3. The pump 1 is provided with a bypass relief (safety) valve 6 and a pump relief valve 7. The oil line is also provided with three check valves 8, 10 and 17 as well as a cable relief valve 9.

Figure 2:
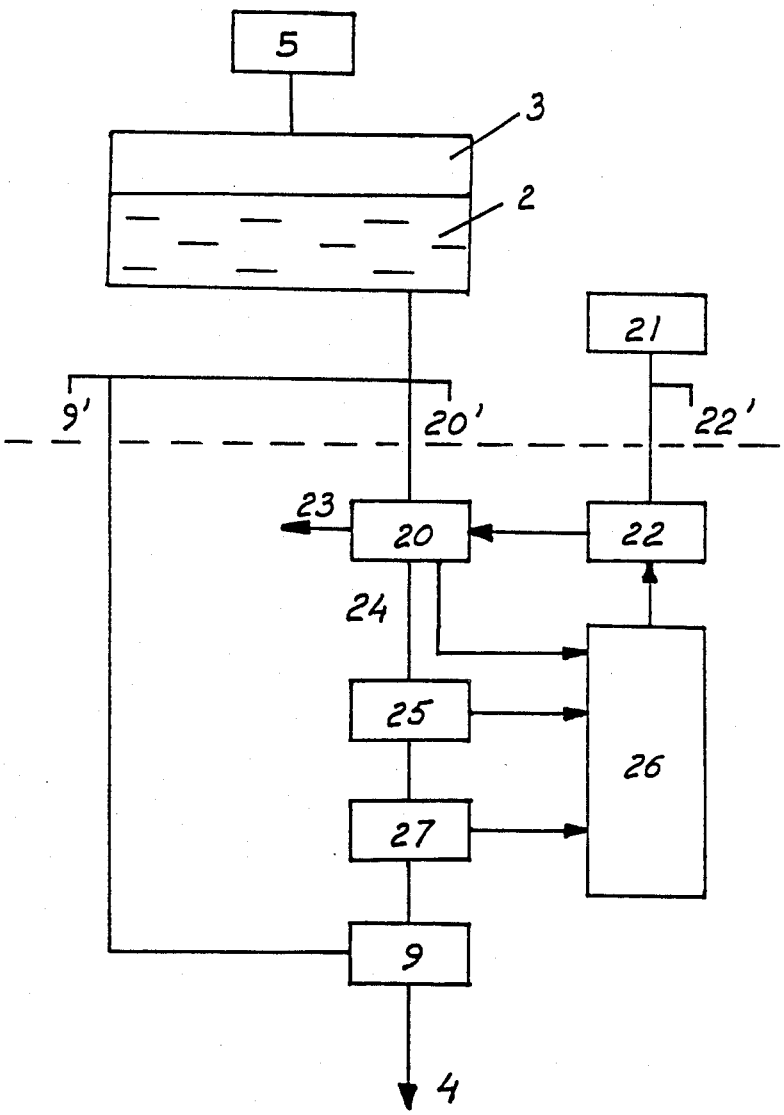
FIG. 2 illustrates a schematic view of the novel pumping plant according to the invention.

In FIG. 2 the canned pump 1 and bypass relief valve 6 in FIG. 1 have been replaced by an nitrogen or air driven pump 20. Only the cable relief valve 9 which allows oil to return to the tank when the pressure increases due to cable heating, remains.

FIG. 2 illustrates an oil cable pumping plant including: at least one oil tank 3; at least one air/gas driven piston type oil pump 20 connected to the oil tank 3; at least one air/gas source 21, such as a compressor, connected to the air/gas inlet of the pump via pressure control means 22, which may be a standard pressure reducer such as the one used on gas bottles an exit 23 for the air/gas as well as an oil exit 24 connected to at least one oil filled cable 4, and an oil flow indicating means 25, such as a piston stroke counter or a flow meter. The pump 20 is of the type which in its normal operating condition provides a predetermined oil pressure at its outlet.

The plant includes an oil flow control means 26 such as a PLS (Programmable Logical System) interconnected between the oil flow indicating means 25 and the air/gas pressure control means 22. The PLS 26 receives and electric pulse for each complete piston stroke and adjusts the setting of the pressure control means (pressure reducer) 22 to obtain the desired flow. The pump 20 is of the type where a desired oil flow can be obtained by setting the gas pressure to a desired value, regardless of the actual oil pressure.

The lower part of FIG. 1 is the so-called 'flow limiting' system, which will allow a high flow in the initial period after a cable severance, when the cable needs a high flow of oil to compensate for the contraction of the oil upon cooling of the cable. After a couple of hours the demand has been reduced considerably, and the upper valve 11 of two electrically operated valves 11 and 12, closes, whereby the flow is limited to the sum of the flows in the lower branches. After another 6–10 hours the second electrically operated valve 12 will close to limit the flow through a flow limiting valve 16 to whatever is needed to keep water out of the severed end once the cable has been cooled down (6–30 liters per hour depending upon oil channel size). Flow limiting valves 14 and 15 are usually introduced in series with the electrically operated valves 11 and 12.

This type of 'flow limiting' system is not required in a pumping plant according to the present invention, as shown in FIG. 2, since a controlled flow may be obtained by monitoring the speed of the pump 20 and adjusting the driving air pressure to obtain the desired flow of oil. This task may, for instance, be performed by the control means 26, which should have a battery back-up in case of power failure. The plant may also include means 27 for detecting a predetermined pressure drop in the oil filled cable(s) 4, due to severance of the cable(s) for example, to initiate the control means 26 to follow a predetermined flow diagram.

In order to assure operation of the sliding piston, even at low pressure and flow, there may be arranged a piston position detector 70 (FIG. 3) which, via the control means 26, will trigger the pressure control means 22 to initiate a short burst of air sufficient to operate the sliding piston at the moment the piston is near or at the end of its upstroke. The air pressure and flow are adjusted by the control means 26 during the first part of the next cycle so as to compensate for the added oil flow during this burst of air.

FIGS. 1 and 2 have been drawn to show a pumping plant for one cable only. When using the FIG. 1 technology for a number of cables, the lower part of the drawing will have to be duplicated for each cable. In the case of FIG. 2 one air driven pump 20 must be used for each cable in order to obtain the 'flow limiting' feature without reducing the oil pressure on the other cables. FIG. 2 indicates that the ports leading to the diagram blocks 9, 20 and 22 may be duplicated with ports 9', 20' and 22' for each cable.

However it is possible to use one control means 26, having a number of ports 20, 20', 22, 22', 25, 25', 27, 27', for controlling a number of cables and for continuously comparing their state.

Figure 3:
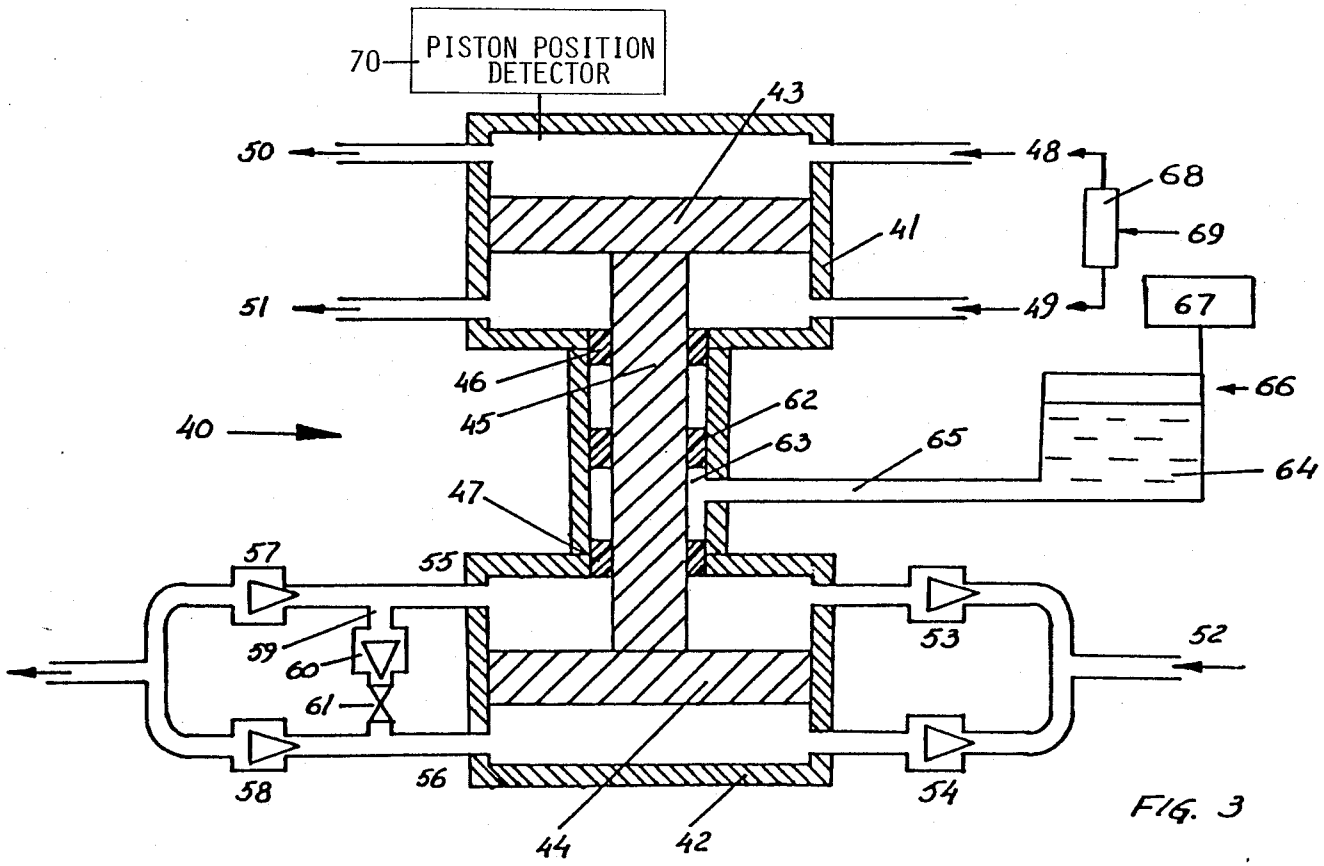
FIG. 3 shows schematically details of a double acting pump according to the invention.

FIG. 3 illustrates a double acting reciprocating pump 40 having an air cylinder 41 and a fluid cylinder 42. The pistons 43 and 44 respectively of the two cylinders are interconnected with a piston rod 45. In the upper part of the air cylinder 41 there is arranged a piston position detector 70. When the piston 43 reaches its upper position, the piston can initiate a signal to the PLS 26, such as by contacting a plunger to operate a microswitch. There is a seal 46 at the entrance of the rod into the air cylinder and there is a seal 47 at its entrance into the fluid cylinder. There is also arranged an outer seal 62 on the piston rod, defining a chamber 63 between this seal and the inner seal 47. The air piston 43 is driven in a reciprocating manner by introducing air at a desired pressure into the air inlets 48 and 49 via a sliding piston assembly 68 from an air inlet 69. The used air escapes through the outlets 50 and 51 via sliding control valves not shown. The fluid to be pumped enters the fluid cylinder through an inlet 52 and two check valves 53 and 54. The fluid is pumped out through two outlets 55 and 56 via two check valves 57 and 58.

If one assumes that the pump 40 is mounted vertically, as illustrated in FIG. 3, with a piston rod 45 extending vertically, the described design may be modified as follows:

A bypass line 59 is installed between the exit ports 55 and 56. A check valve 60 allows oil to pass only from the lower to the upper cylinder chamber. Finally a shut off valve 61 is installed in series with this latter check valve, to be shut if this feature of the invention is not required.

The operation of this pump may be explained as follows:

When the valve 61 in the bypass line is open, no pumping action will be obtained when the piston 45 is moving downwards, since the oil will only be moved from the lower to the upper chamber, and the seal 47 is maintained under positive pressure.

When the piston 45 moves upwards, oil will be sucked into the lower chamber while oil from the top chamber is being expulsed. While it is true that the pumping action during a down-stroke is lost, the piston will move much faster in this direction, since we have the same pressure above and underneath the piston. The speed with which pumping action is regained is only dependent on the restriction to flow through the bypass line 59. The double acting pump is now turned into a single acting pump. Some slight pumping action will be obtained on the down-stroke due to the difference in active piston area (equal to the volume of the piston rod). This means that the seal 47 is subjected to full pumping pressure very shortly after starting the down-stroke.

While vacuum leaks past the piston seal 62 and 47 could also be avoided by connecting the chamber 63 between the two seals to the high pressure side of the pump, this solution is undesirable because it puts an unnecessary strain on the outer seal 62, which could cause a slight leakage of oil.

To avoid air leaks passed the seal 47, the chamber 63 may be filled with 'seal oil' 64 supplied via a line 65 from a reservoir 66. The level or pressure of the oil 64 may be monitored by means 67 to observe leaks through the seals 47 and 62. The seal oil may be of the same type as the cable oil or it may have high viscosity to give better lubrication. The seal oil must, however, be fully compatible with the cable oil.

If the plant has a number of air pumps of the described type, all may be supplied with 'seal-oil' from a separate pump operating as a single acting pump as described above. Thereby vacuum leaks past the seals 46, 62 and 47 are avoided under all operating conditions for all the pumps. In addition, the condition of the seals on all the working pumps supplied with seal oil from the 'seal oil pump' may be continuously checked by monitoring pressure and flow in the 'seal-oil' lines. The pressure of the 'seal oil' may now be set at the valve which will assure maximum life of the seals, whether that be just above atmospheric pressure or, may be, half the operating pressure, in which latter case the two seals will share the load.

It will be understood that the feature of having an oil filled chamber 63 surrounding the piston rod, may also be used in connection with single acting pumps like that described in U.S. Pat. Nos. 4,405,292 and in U.S. Pat. No. 3,963,383 (Haskel) to prevent air and gas from being sucked into the cable.

The above detailed description of embodiments of this invention must be taken as examples only and should not be considered as limitations on the scope of protection.

We claim:

1. In an oil cable pumping plant including at least one oil tank and at least one air/gas driven piston type oil pump connected to the oil tank, at least one air/gas source connected to the air/gas inlet of the pump via pressure control means, an exit for the air/gas as well as an oil exit connected to at least one oil filled cable, and oil flow indicating means, the pump in its normal operating condition providing a predetermined oil pressure at its outlet, the improvement comprising: an oil flow control means interconneeted between the oil flow indicating means and the air/gas pressure control means for controlling the oil flow to the cable.

2. A pumping plant according to claim 1, wherein the oil flow control means is interconnected between a respective one of said oil flow indicating means and a respective one of said control means for controlling each respective cable thereby being able to control, monitor and compare their respective conditions.

3. Pumping plant according to claim 1, further comprising a pressure detecting means for detecting a predetermined pressure drop in the oil filled cable and signaling the flow control means to follow a predetermined flow diagram.

4. Pumping plant according to claim 1, wherein said pump includes a piston and the plant further comprises a piston position detector, operation of the sliding piston is assured, even at low pressure and flow, by applying a short burst of air sufficient to operate the sliding piston when the piston is near or at the end of its stroke, and the air pressure and flow are adjusted during the first part of the next piston stroke so that the pump is compensated for the added oil flow during this burst of air.

5. Pumping plant according to claim 1, wherein the air/gas source is a compressor.

6. Pumping plant according to claim 1, wherein the oil flow indicating means is a piston stroke counter.

7. Pumping plant according to claim 1, wherein the oil flow indicating means is a flow meter.

8. Pumping plant according to claim 1, wherein the oil flow control means is a programmable logical system.

9. Pumping plant according to claim 1, wherein said pump is a double acting reciprocating pump which includes a bypass line, two oil exit lines, each line leading from a respective upper and lower chamber of the pump, and a check valve positioned to allow oil to move from the lower to the upper chamber so that the pump performs as a single acting pump thereby avoiding pressure below ambient from occurring in the upper chamber, and wherein the bypass line is connected between the oil exit lines.

10. Pumping plant according to claim 9, further comprising a further valve installed in the by-pass line, which when closed, will return the pump to normal double acting pump operation.

11. Pumping plant according to claim 1, further comprising a reservoir and wherein said pump includes a piston rod and two seals defining a chamber within which degasified oil from said reservoir is maintained at a predetermined pressure.

12. Pumping plant according to claim 11, further comprising means for maintaining at least one of the pressure and level of the reservoir and for monitoring the condition of the two seals.

13. Pumping plant according to claim 11, wherein the reservoir contains oil which is compatible with the oil pumped into the cable and the oil has a higher viscosity than the oil pumped into the cable.

14. Pumping plant according to claim 12, wherein said maintaining and monitoring means is a pump.

* * * * *